US007479974B2

(12) United States Patent
Kobayashi

(10) Patent No.: US 7,479,974 B2
(45) Date of Patent: Jan. 20, 2009

(54) IMAGE FORMING APPARATUS

(75) Inventor: Hideo Kobayashi, Daito (JP)

(73) Assignee: Funai Electric Co., Ltd. (JP)

( * ) Notice: Subject to any disclaimer, the term of this patent is extended or adjusted under 35 U.S.C. 154(b) by 267 days.

(21) Appl. No.: 11/449,835

(22) Filed: Jun. 9, 2006

(65) Prior Publication Data

US 2007/0046763 A1 Mar. 1, 2007

(51) Int. Cl.
*B41J 2/325* (2006.01)

(52) U.S. Cl. ..... 347/171

(58) Field of Classification Search ..... 347/171, 347/221

See application file for complete search history.

(56) References Cited

U.S. PATENT DOCUMENTS 6,471,424 B1 * 10/2002 Hirose ..... 400/282
2008/0075509 A1 * 3/2008 Takiguchi et al. ..... 399/388

FOREIGN PATENT DOCUMENTS

JP 11-245549 9/1999
JP 2000-255113 9/2000

* cited by examiner

*Primary Examiner*—Huan H Tran
(74) *Attorney, Agent, or Firm*—Bacon & Thomas, PLLC

(57) ABSTRACT

There is provided an image forming apparatus capable of easily determining the direction of setting printing paper in a paper feed cartridge with an extremely simple structure. In the image forming apparatus 1 comprising: a paper feed cartridge 2 for placing printing paper P with an absorbing layer made of material for thermal transfer recording formed thereon; an ink ribbon 3 with dye applied thereto; and printing means 4 for sublimating or melting and diffusing the dye and for transferring the sublimated or melted and diffused dye to the printing paper, the printing paper P has a printing area P1 and a margin Px as a non-printing area P2 adapted not to be printed substantially on a first surface Pa with the absorbing layer formed thereon, while has a postal documentation area 7 composed of a stamp portion 71 and/or a zip code portion 72 on a second surface Pb, in both the margin Px and the paper feed cartridge 2 being formed positioning symbols 6 and 8 for indicating the direction of setting the printing paper P in the paper feed cartridge 2.

10 Claims, 3 Drawing Sheets

IMAGE FORMING APPARATUS

BACKGROUND OF THE INVENTION

1. Field of the Invention

The present invention relates to an image forming apparatus such as a dye-sublimation, dye-sublimation laser, thermal transfer, or electrophotographic one.

2. Description of the Prior Art

Dye-sublimation image forming apparatuses, for example, are adapted to perform predetermined printing (e.g. color printing) by laying an ink ribbon with sublimation dye applied thereto on printing paper, applying electrical energy according to image information to a heat-sensitive head (thermal head), and sublimating and transferring the sublimation dye applied to the ink ribbon onto the special-purpose printing paper using thermal energy generated from the heat-sensitive head. Thus, such dye-sublimation image forming apparatuses are adapted to control, for example, the amount of energization of the heat-sensitive head, that is, the amount of heat generation in the head to reproduce a tonal image, attracting wide attention as capable of reproducing a high-quality color image yet with a small size and a simple structure.

Meanwhile, this kind of image forming apparatus is required to use special-purpose printing paper with an absorbing layer made of material for thermal transfer recording formed thereon. There have been marketed such printing papers that may be used as postcards by, for example, printing a photo on one surface (first surface) with an absorbing layer formed thereon, while a postal documentation area composed of a stamp portion and/or a zip code portion is printed preliminarily on the other surface (second surface).

However, when setting such printing paper with a postal documentation area printed on the second surface thereof in a paper feed cartridge of an image forming apparatus to print a photo on the first surface thereof, it is difficult to determine whether the printing paper should be arranged in either longitudinal or lateral direction with respect to the paper feed direction of the paper feed cartridge. It is only necessary to perform test printing in advance to avoid this difficulty, but special-purpose printing papers with an absorbing layer formed thereon to be used in this kind of image forming apparatus are extremely expensive relative to plain papers to be used in normal ink-jet image forming apparatuses, and test printing will waste expensive printing paper and ink ribbon, being extremely uneconomical. Further, although it can be considered to use plain paper as printing paper, plain paper, if used, will be attached firmly and undetachably to the ink ribbon in this kind of image forming apparatus, which makes it impossible to use plain paper. It is therefore impossible to perform test printing using inexpensive plain paper.

There has conventionally been proposed, for example, a double-sided image forming apparatus in which a print controller is adapted to direct printing of a first symbol, in a printing operation, that indicates whether one surface of paper that has already been printed should be arranged in either longitudinal or lateral direction with respect to the paper feed direction of a paper feed cartridge, and whether the paper should be set in the paper feed cartridge with the one surface that has already been printed up or down, when resetting the paper in the paper feed cartridge to print the other surface thereof (refer to Japanese Patent Laid-Open Publication No. 2000-255113 for example).

There has also been proposed a to-be-printed matter composed of sheets of cut paper with an identification mark for identifying the direction of the to-be-printed matter provided in one cut corner thereof (refer to Japanese Patent Laid-Open Publication No. Hei 11-245549 for example).

However, the arrangement described in Japanese Patent Laid-Open Publication No. 2000-255113 suffers from the following problems. In the image forming apparatus, since the print controller is adapted to direct printing of a first symbol that indicates whether paper should be set in the paper feed cartridge with one surface that has already been printed up or down, it is inevitably necessary to print the both surfaces of the paper. Therefore, when applying the arrangement to, for example, a dye-sublimation image forming apparatus, it is necessary to use printing paper with absorbing layers made of material for thermal transfer recording formed on the both surfaces thereof, even though a tonal image such as a photo is to be printed only on one surface. This consequently requires expensive printing paper to be used and the print controller to have a specific function of printing a first symbol, which causes the image forming apparatus itself to be complicated and expensive. Further, a first symbol is to be printed even in a margin, resulting in a poor appearance after the printing operation.

Also, the arrangement described in Japanese Patent Laid-Open Publication No. Hei 11-245549 suffers from a problem in that the identification mark is only for verifying that the to-be-printed matter is stacked infallibly in the same direction, and cannot identify the set direction with respect to the paper feed cartridge.

SUMMARY OF THE INVENTION

The present invention has been made to solve the above-described problems, and an object thereof is to provide an image forming apparatus capable of easily determining the direction of setting printing paper in a paper feed cartridge with an extremely simple structure.

In order to achieve the foregoing object, a first aspect of the present invention is a dye-sublimation image forming apparatus comprising: a paper feed cartridge for placing printing paper with an absorbing layer made of material for thermal transfer recording formed thereon; an ink ribbon with sublimation dye applied thereto; and a heat-sensitive head for sublimating the sublimation dye and for transferring the sublimated sublimation dye to the printing paper using thermal energy, wherein the printing paper has a printing area and a margin as a non-printing area adapted not to be printed substantially on a first surface with the absorbing layer formed thereon, while has a postal documentation area composed of a stamp portion and/or a zip code portion on a second surface, in both the margin and the paper feed cartridge being formed approximately the same positioning symbols for indicating the direction of setting the printing paper in the paper feed cartridge.

In accordance with the arrangement above, when setting the printing paper in the paper feed cartridge, it is only required to align the positioning symbol formed in the margin with approximately the same positioning symbol formed in the paper feed cartridge. It is therefore possible to set the printing paper extremely easily and reliably in the paper feed cartridge, and it is not necessary to perform test printing to verify the set direction of the printing paper, being extremely economical. Further, the positioning symbol formed in the printing paper, which is within the margin and is to be separated when using the paper as a postcard, cannot impair the appearance as a good-looking postcard.

Also, a second aspect of the present invention is an image forming apparatus comprising: a paper feed cartridge for placing printing paper with an absorbing layer made of material for thermal transfer recording formed thereon; an ink ribbon with dye applied thereto; and printing means for sublimating or melting and diffusing the dye and for transferring the sublimated or melted and diffused dye to the printing paper, wherein the printing paper has a printing area and a margin as a non-printing area adapted not to be printed substantially on a first surface with the absorbing layer formed thereon, while has a postal documentation area composed of a stamp portion and/or a zip code portion on a second surface, in both the margin and the paper feed cartridge being formed positioning symbols for indicating the direction of setting the printing paper in the paper feed cartridge.

In accordance with the arrangement above, when setting the printing paper in the paper feed cartridge, it is only required to align the positioning symbol formed in the margin with the positioning symbol formed in the paper feed cartridge. It is therefore possible to set the printing paper extremely easily and reliably in the paper feed cartridge, and it is not necessary to perform test printing to verify the set direction of the printing paper, being extremely economical. Further, the positioning symbol formed in the printing paper, which is within the margin and is to be separated when using the paper as a postcard, cannot impair the appearance as a good-looking postcard.

Further, in a third aspect of the present invention, the paper feed cartridge comprises a placing part for placing the printing paper thereon and a cover part, the positioning symbol being formed in the placing part.

In accordance with the arrangement above, since the positioning symbol is formed in the placing part, the printing paper can advantageously be set in the paper feed cartridge while being verified.

In addition, in a fourth aspect of the present invention, the paper feed cartridge comprises a placing part for placing the printing paper thereon and a cover part, the positioning symbol being formed in the cover part.

In accordance with the arrangement above, since the positioning symbol is formed in the cover part, the printing paper can advantageously be set in the paper feed cartridge after the set direction being verified in advance.

Also, in a fifth aspect of the present invention, the paper feed cartridge comprises a placing part for placing the printing paper thereon and a cover part, the positioning symbol being formed in both the placing part and the cover part.

In accordance with the arrangement above, since the positioning symbol is formed in both the placing part and the cover part, the printing paper can advantageously be set in the paper feed cartridge after the set direction being verified in advance and further while being verified.

Furthermore, in a sixth aspect of the present invention, the positioning symbols formed in the printing paper and the paper feed cartridge have a portrait symbol for the case of using the printing paper in a portrait manner and a landscape symbol for the case of using the printing paper in a landscape manner, the portrait symbol and the landscape symbol having respective different forms.

In accordance with the arrangement above, the printing paper and the paper feed cartridge have a portrait symbol for the case of using the printing paper in a portrait manner and a landscape symbol for the case of using the printing paper in a landscape manner, the portrait symbol and the landscape symbol having respective different forms. Therefore, it is advantageously possible to support printing papers both for portrait and landscape use.

In accordance with the present invention, it is possible to achieve an image forming apparatus capable of easily determining the direction of setting printing paper in a paper feed cartridge with an extremely simple structure.

DESCRIPTION OF THE PREFERRED EMBODIMENTS

First Embodiment

Figure 1:
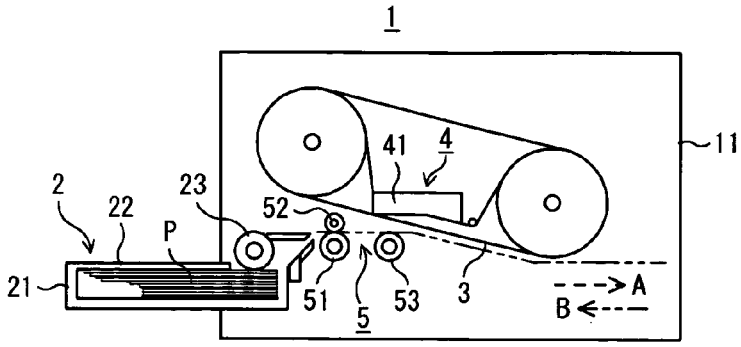
FIG. 1 is a schematic configuration diagram showing a dye-sublimation image forming apparatus according to an embodiment of the present invention.
Figure 2:
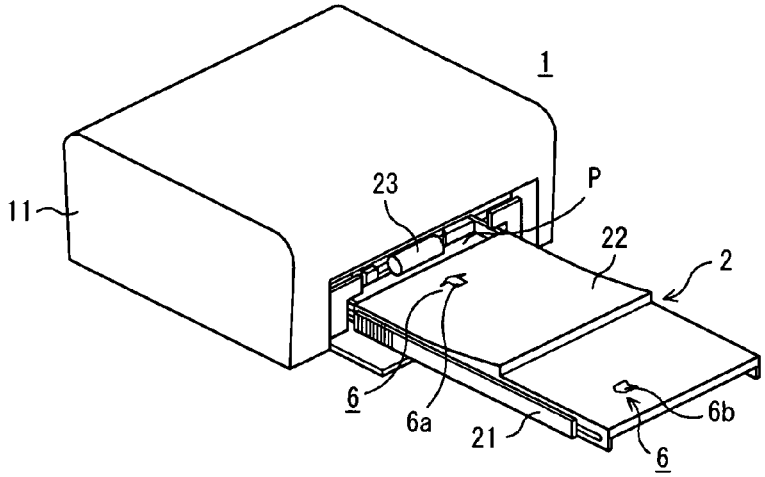
FIG. 2 is a perspective view of the image forming apparatus shown in FIG. 1.
Figure 3:
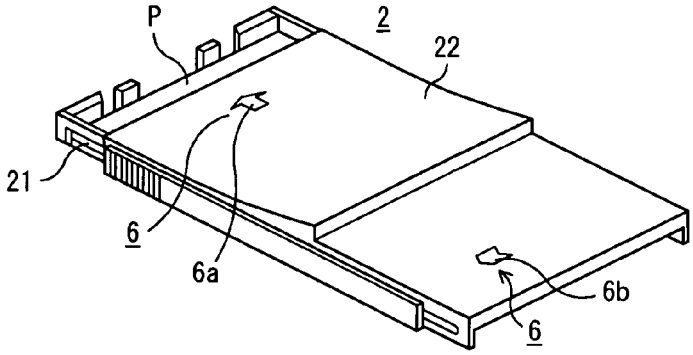
FIG. 3 is a perspective view showing an example of a paper feed cartridge of the image forming apparatus shown in FIG. 1.
Figure 4:
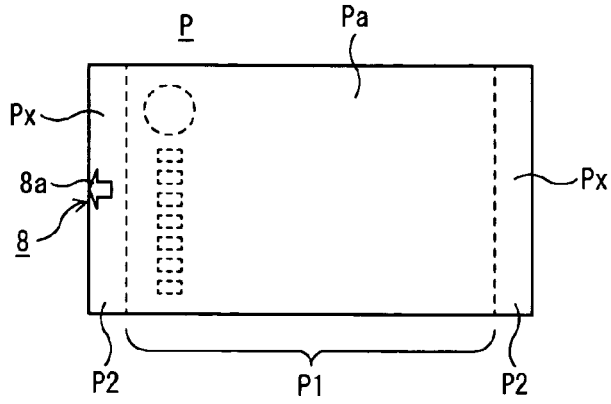
FIG. 4 is a view showing a first surface of printing paper when used in a portrait manner.
Figure 5:
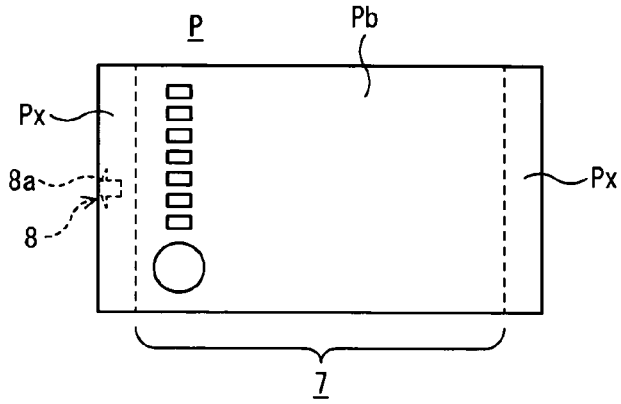
FIG. 5 is a view showing a second surface of the printing paper when used in a portrait manner.
Figure 6:
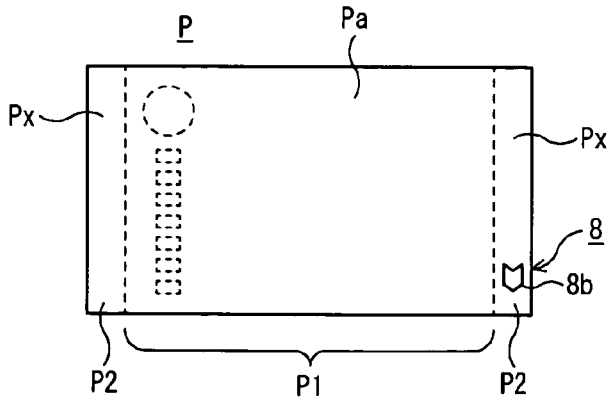
FIG. 6 is a view showing a first surface of printing paper when used in a landscape manner.
Figure 7:
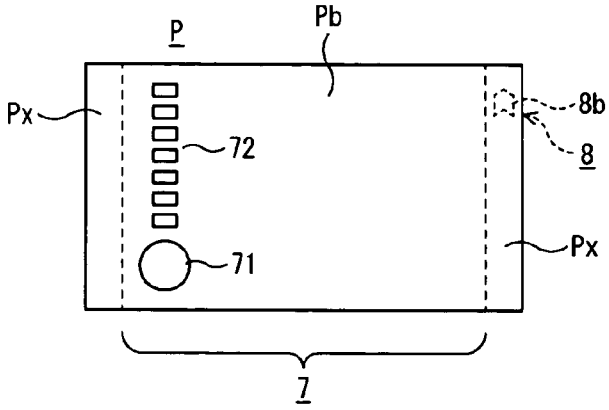
FIG. 7 is a view showing a second surface of the printing paper when used in a landscape manner.

An embodiment of the present invention will hereinafter be described based on FIGS. 1 to 7. FIG. 1 is a schematic configuration diagram showing a dye-sublimation image forming apparatus according to an embodiment of the present invention; FIG. 2 is a perspective view of the image forming apparatus shown in FIG. 1; and FIG. 3 is a perspective view showing an example of a paper feed cartridge of the image forming apparatus shown in FIG. 1. FIGS. 4 and 5 show an example where printing paper is used in a portrait manner, where FIG. 4 is a view showing a first surface of the printing paper and FIG. 5 is a view showing a second surface. FIGS. 6 and 7 show an example where printing paper is used in a landscape manner, where FIG. 6 is a view showing a first surface of the printing paper and FIG. 7 is a view showing a second surface.

As shown in FIG. 1, the dye-sublimation image forming apparatus 1 comprises: a paper feed cartridge 2 for placing printing paper P thereon; an ink ribbon 3 with sublimation dye applied thereto; printing means 4 for sublimating the sublimation dye applied to the ink ribbon 3 and for forming, that is, printing an image on the printing paper P; paper carrying means 5 for carrying the printing paper P sequentially toward the printing means 4; and components not shown in the figure such as control means, drive means such as a motor, and a power supply section.

The ink ribbon 3 is obtained by dissolving sublimation dye in, for example, acetate or polyester solution, adding dispersant to the mixture to make colloidal ink solution, mixing binder with the solution, and applying the solution onto a base material such as paper or film, the ribbon being provided with yellow, magenta, and cyan printing areas and a surface protection layer area (OP layer) as well known. The yellow, magenta, and cyan printing areas and the surface protection layer area each have approximately the same dimension as the maximum dimension (width and length) of an image to be transferred. There are also provided identifying portions, respectively, between the areas.

The printing paper P generally has an absorbing layer made of material for thermal transfer recording formed on a printing paper base material. As the material for thermal transfer recording, there is generally used material in which additive such as lubricant is added to polyester resin or polycarbonate resin, etc.

The printing means 4 is composed of, for example, a heat-sensitive head 41 in which heater elements are arranged linearly over approximately the same length as the width of an image to be printed, the heater elements being adapted to convert electrical energy into thermal energy based on printing data. Each heater element is supplied with a color signal obtained by resolving the image into three primary colors of yellow (Y), magenta (M), and cyan (C). Each heater element is adapted to become either heated or unheated based on the color signal, whereby the sublimation dye applied to the ink ribbon is to be sublimated or melted and diffused at portions facing heater elements to be heated and then transferred to the printing paper P to form an image.

The paper feed cartridge 2 comprises a placing part 21 for placing and housing the printing paper P therein and a cover part 22, the cartridge being adapted to feed printing paper P on the top of the paper stack placed on the placing part 21 sequentially toward the paper carrying means 5 through the rotational operation of a paper feed roller 23. It is noted that the printing means 4 shown in the present embodiment is adapted to perform printing on the upper side surface of the printing paper P that the means faces through the heat-sensitive head 41 and the ink ribbon 3. It is therefore necessary to place the printing paper P on the paper feed cartridge 2 with the first surface Pa (refer to FIG. 4) up.

The paper carrying means 5 is adapted to repeat longitudinal back-and-forth carrying of the printing paper P using a feed roller 51, etc. in response to the sequential transferring of each color area so that color overprinting is to be performed using the ink ribbon 3 with three colors of sublimation dye applied thereto. The printing paper P fed to the paper carrying means 5 is carried sequentially toward the printing means 4 while being pressed (held) between the feed roller 51 and a holding roller 52 that is disposed in such a manner as to face the feed roller 51. In the paper carrying means 5, a platen roller 53 is disposed in such a manner as to face the heat-sensitive head 41.

The printing paper P carried toward the printing means 4 is then carried from left to light (in the direction indicated by the arrow A) in FIG. 1 at approximately the same rate as the ink ribbon 3. At the same time, the heat-sensitive head 41 is supplied with yellow image data from the control means not shown in the figure. When heater elements of the heat-sensitive head 41 are heated with the data supply, the sublimation dye is sublimated at portions facing the elements and transferred (attached) to the first surface Pa of the printing paper P (refer to FIG. 4) to form an yellow (Y) image on the printing paper P. After the yellow image is formed on the first surface Pa of the printing paper P, the heat-sensitive head 41 will be lifted by a motor not shown in the figure. Then, the control means will perform control operations to rewind the ink ribbon 3 until the leading end of the magenta printing area on the ink ribbon 3 is detected by, for example, an ink ribbon sensor not shown in the figure. Also, the paper carrying means 5 will be driven to carry the printing paper P in the direction indicated by the arrow B until the leading end thereof reaches the position where to perform printing. This operation allows a magenta image to be formed on the printing paper P. Then, the above-described operations will be repeated for each color of magenta, cyan, and surface protection layer (transparent and colorless) to form a color image, that is, to perform color overprinting in an image area P1 on the first surface Pa of the printing paper P. It is noted that the heat-sensitive head 41 is first lifted upward to form enough clearance with the platen roller 53 in order not to interfere with the carrying of the ink ribbon 3 and the printing paper P.

After the color image is formed on the printing paper P, the control means will reversely drive the motor for driving the heat-sensitive head 41 up and down to lift the heat-sensitive head 41, and then drive a carrying motor and a discharge motor to control the paper carrying means 5 so that the printing paper P is discharged from the image forming apparatus main body 11 to be carried toward, for example in FIG. 1, a paper discharge part provided on the cover part 22 of the paper feed cartridge 2, though not shown in the figure.

Thus, in accordance with the present invention, the cover part 22 of the paper feed cartridge 2 has a positioning symbol 6 for indicating the direction of setting the printing paper P on the placing part 21 of the paper feed cartridge 2 formed therein, as shown in FIGS. 2 and 3. The positioning symbol 6 includes, for example, a portrait symbol (arrow) 6*a* for indicating the set direction when printing the printing paper P in a portrait manner and a landscape symbol (chevron) 6*b* for indicating the set direction when printing the printing paper P in a landscape manner. The positioning symbol 6 can be formed by, for example, painting, attaching a decal, or imprinting.

Then, as shown in FIGS. 4 and 5, printing paper P to be printed in a portrait manner has a printing area P1 and a margin Px as a non-printing area P2 adapted not to be printed substantially formed on a first surface Pa with an absorbing layer formed thereon. The margin Px has a positioning symbol 8 for indicating the set direction when printing the printing paper P in a portrait manner. The positioning symbol 8 includes, for example, approximately the same portrait symbol (arrow) 8*a* as the portrait symbol 6*a* formed in the cover part 22.

Also, as shown in FIGS. 6 and 7, printing paper P to be printed in a landscape manner has a printing area P1 and a margin Px as a non-printing area P2 adapted not to be printed substantially formed on a first surface Pa with an absorbing layer formed thereon. The margin Px has a positioning symbol 8 for indicating the set direction when printing the printing paper P in a landscape manner. The positioning symbol 8 includes, for example, approximately the same landscape symbol (chevron) 8*b* as the landscape symbol 6*b* formed in the cover part 22.

In thus arranged present embodiment, when setting the printing paper P shown in FIG. 4 in the paper feed cartridge 2 for portrait printing for example, the set direction, that is, the portrait symbol 6*a* formed in the cover part 22 will be verified in advance, and then approximately the same portrait symbol 8*a* formed in the margin Px of the printing paper P will be aligned with the portrait symbol 6*a* to set the printing paper P on the placing part 21 of the paper feed cartridge 2.

Also, when setting the printing paper P shown in FIG. 6 in the paper feed cartridge 2 for landscape printing, the set direction, that is, the landscape symbol 6*b* formed in the cover part 22 will be verified in advance, and then approximately the same landscape symbol 8*b* formed in the margin Px of the printing paper P will be aligned with the landscape symbol 6*b* to set the printing paper P on the placing part 21 of the paper feed cartridge 2.

In thus arranged present embodiment, when setting the printing paper P in the paper feed cartridge 2, it is only required to align the positioning symbol 8 formed in the margin Px with approximately the same positioning symbol 6 formed in the paper feed cartridge 2. It is therefore possible to set the printing paper P extremely easily and reliably in the paper feed cartridge 2, and it is not necessary to perform test printing to verify the set direction of the printing paper P, being extremely economical. Further, the positioning symbol formed in the printing paper, which is within the margin Px and is to be separated when using the paper as a postcard, cannot impair the appearance as a good-looking postcard.

In addition, the paper feed cartridge 2 has the positioning symbol 6 including the portrait symbol for the case of using the printing paper in a portrait manner and the landscape symbol for the case of using the printing paper in a landscape manner, the portrait symbol and the landscape symbol having their respective different forms. Therefore, it is advantageously possible to support printing papers both for portrait and landscape use.

Second Embodiment

Figure 8:
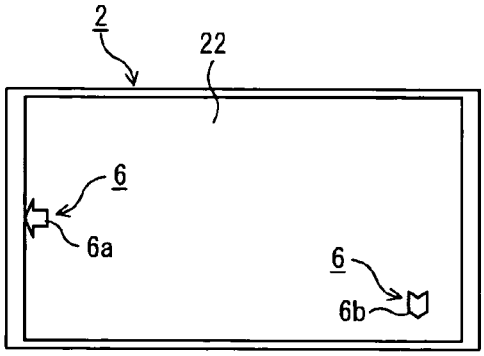
FIG. 8 is a schematic configuration diagram showing a substantial part of a paper feed cartridge of an image forming apparatus according to a second embodiment of the present invention.
Figure 9:
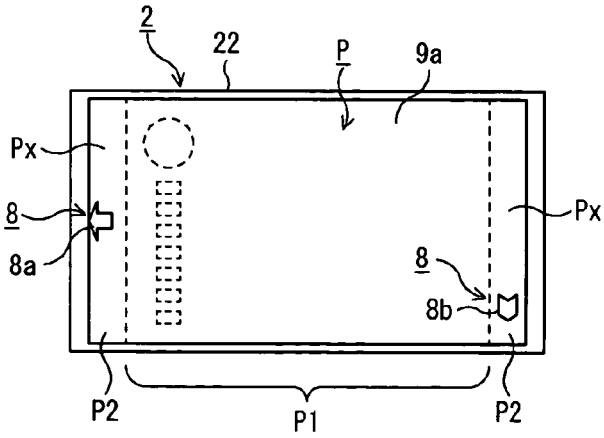
FIG. 9 is a schematic configuration diagram showing the state where printing paper is set in the paper feed cartridge shown in FIG. 8 with the first surface up.

Next will be described a second embodiment of the present invention with reference to FIGS. 8 and 9. FIG. 8 is a schematic configuration diagram showing a substantial part of a paper feed cartridge of an image forming apparatus according to a second embodiment of the present invention; and FIG. 9 is a schematic configuration diagram showing the state where printing paper is set in the paper feed cartridge shown in FIG. 8 with the first surface up. It is noted that in FIGS. 8 and 9, since components designated by the same reference numerals as shown in FIGS. 1 to 7 are approximately the same, detailed descriptions will be omitted here. Differences from the above-described embodiment will hereinafter be described mainly.

In the present embodiment, the bottom surface of the placing part 21 of the paper feed cartridge 2, which is for placing printing paper P thereon, has a positioning symbol 6 for indicating the direction of setting the printing paper P on the placing part 21 of the paper feed cartridge 2 formed therein, as shown in FIG. 8. The positioning symbol 6 includes, for example, a portrait symbol (arrow) 6*a* for indicating the set direction when printing the printing paper P in a portrait manner and a landscape symbol (chevron) 6*b* for indicating the set direction when printing the printing paper P in a landscape manner.

Then, as shown in FIG. 9, the printing paper P has a printing area P1 and a margin Px as a non-printing area P2 adapted not to be printed substantially formed on a first surface Pa with an absorbing layer formed thereon. The margin Px has a positioning symbol 8 for indicating the set direction when printing the printing paper P in a portrait manner and a positioning symbol 8 for indicating the set direction when printing in a landscape manner. The positioning symbol 8 includes, for example, approximately the same portrait symbol (arrow) 8*a* as the portrait symbol 6*a* formed in the placing part 21 and approximately the same landscape symbol (chevron) 8*b* as the landscape symbol 6*b* formed in the placing part 21.

Thus arranged present embodiment will exhibit the same effects as those of the above-described embodiment, and further the printing paper P and the paper feed cartridge 2 have the portrait symbols 6*a* and 8*a* for the case of using the printing paper P in a portrait manner and the landscape symbols 6*b* and 8*b* for the case of using the printing paper P in a landscape manner, the portrait symbols 6*a* and 8*a* and the landscape symbols 6*b* and 8*b* having their respective different forms. Therefore, it is advantageously possible to support printing papers P both for portrait and landscape use.

Also, since the positioning symbol 6 is formed in the placing part 21, the printing paper P can advantageously be set in the paper feed cartridge 2 while being verified.

It is noted that although the above-described embodiments are preferred practical examples of the present invention, the present invention is not restricted thereto, and various modifications may be made without departing from the gist of the present invention.

For example, although the above-described embodiments describe the dye-sublimation image forming apparatus, it will be appreciated that the present invention may be applied to other color field sequential image forming apparatuses such as thermal transfer ones and electrophotographic ones as long as employing a color field sequential method.

Also, a laser printing head may be used as the printing means 4. The laser printing head has a semiconductor laser for emitting a laser beam based on printing data and an imaging lens for collecting and imaging the laser beam emitted from the semiconductor laser onto an ink ribbon 3, the semiconductor laser and the imaging lens being housed in the same casing.

Further, it will be appreciated that the positioning symbol 6 may be formed in both the placing part 21 and the cover part 22 of the paper feed cartridge 2. In accordance with this arrangement, the printing paper P can advantageously be set in the paper feed cartridge 2 after the set direction being verified in advance using the positioning symbol 6 formed in the cover part 22 and further while being verified using the positioning symbol 6 formed in the placing part 21.

In addition, although the above-described embodiments describe the ink ribbon 3 provided with the yellow, magenta, and cyan printing areas and the surface protection layer area, it will be appreciated that an ink ribbon with no surface protection layer area may be used.

Furthermore, although the above-described embodiments describe in detail the image forming apparatus adapted to print the upper side surface of the printing paper P that is set on the placing part 21 of the paper feed cartridge 2, it will be appreciated that in the case of printing paper P to be used in an image forming apparatus adapted to print the lower side surface of the printing paper P that is set on a placing part 21, it is only required to form a positioning symbol 8 in the margin Px on the second surface Pb of the printing paper P.

What is claimed is:

1. A dye-sublimation image forming apparatus comprising: a paper feed cartridge for placing printing paper with an absorbing layer made of material for thermal transfer recording formed thereon; an ink ribbon with sublimation dye applied thereto; and a heat-sensitive head for sublimating said sublimation dye and for transferring said sublimated sublimation dye to said printing paper using thermal energy, wherein said printing paper has a printing area and a margin as a non-printing area adapted not to be printed substantially on a first surface with said absorbing layer formed thereon, while has a postal documentation area composed of a stamp portion and/or a zip code portion on a second surface, in both said margin and said paper feed cartridge being formed approximately the same positioning symbols for indicating the direction of setting said printing paper in said paper feed cartridge.

2. The image forming apparatus according to claim 1, wherein said paper feed cartridge comprises a placing part for placing said printing paper thereon and a cover part, said positioning symbol being formed in said placing part.

3. The image forming apparatus according to claim 2, wherein said positioning symbols formed in said printing paper and said paper feed cartridge have a portrait symbol for the case of using said printing paper in a portrait manner and a landscape symbol for the case of using said printing paper in a landscape manner, said portrait symbol and said landscape symbol having respective different forms.

4. The image forming apparatus according to claim 1, wherein said paper feed cartridge comprises a placing part for placing said printing paper thereon and a cover part, said positioning symbol being formed in both said placing part and said cover part.

5. The image forming apparatus according to claim 4, wherein said positioning symbols formed in said printing paper and said paper feed cartridge have a portrait symbol for the case of using said printing paper in a portrait manner and a landscape symbol for the case of using said printing paper in a landscape manner, said portrait symbol and said landscape symbol having respective different forms.

6. The image forming apparatus according to claim 1, wherein said positioning symbols formed in said printing paper and said paper feed cartridge have a portrait symbol for the case of using said printing paper in a portrait manner and a landscape symbol for the case of using said printing paper in a landscape manner, said portrait symbol and said landscape symbol having respective different forms.

7. An image forming apparatus comprising: a paper feed cartridge for placing printing paper with an absorbing layer made of material for thermal transfer recording formed thereon; an ink ribbon with dye applied thereto; and printing means for sublimating or melting and diffusing said dye and for transferring said sublimated or melted and diffused dye to said printing paper, wherein said printing paper has a printing area and a margin as a non-printing area adapted not to be printed substantially on a first surface with said absorbing layer formed thereon, while has a postal documentation area composed of a stamp portion and/or a zip code portion on a second surface, in both said margin and said paper feed cartridge being formed positioning symbols for indicating the direction of setting said printing paper in said paper feed cartridge.

8. The image forming apparatus according to claim 7, wherein said paper feed cartridge comprises a placing part for placing said printing paper thereon and a cover part, said positioning symbol being formed in said placing part.

9. The image forming apparatus according to claim 7, wherein said paper feed cartridge comprises a placing part for placing said printing paper thereon and a cover part, said positioning symbol being formed in both said placing part and said cover part.

10. The image forming apparatus according to claim 7, wherein said positioning symbols formed in said printing paper and said paper feed cartridge have a portrait symbol for the case of using said printing paper in a portrait manner and a landscape symbol for the case of using said printing paper in a landscape manner, said portrait symbol and said landscape symbol having respective different forms.

* * * * *

UNITED STATES PATENT AND TRADEMARK OFFICE

CERTIFICATE OF CORRECTION

PATENT NO. : 7,479,974 B2
APPLICATION NO. : 11/449835
DATED : January 20, 2009
INVENTOR(S) : Hideo Kobayashi It is certified that error appears in the above-identified patent and that said Letters Patent is hereby corrected as shown below:

Title page, item [30] should read

--Foreign Application Priority Data
Sept. 1, 2005 (JP) ..... 2005-253037--

Signed and Sealed this

Thirtieth Day of June, 2009

John Doll

JOHN DOLL
*Acting Director of the United States Patent and Trademark Office*